US008118606B2

(12) United States Patent
Larsson

(10) Patent No.: US 8,118,606 B2
(45) Date of Patent: Feb. 21, 2012

(54) CONDUCTOR ARRANGEMENT, SYSTEM AND METHOD

(76) Inventor: Martin Larsson, Valberg (SE)

( * ) Notice: Subject to any disclaimer, the term of this patent is extended or adjusted under 35 U.S.C. 154(b) by 0 days.

(21) Appl. No.: 12/515,350

(22) PCT Filed: Nov. 19, 2007

(86) PCT No.: PCT/SE2007/050861

§ 371 (c)(1),
(2), (4) Date: Nov. 19, 2009

(87) PCT Pub. No.: WO2008/060239

PCT Pub. Date: May 22, 2008

(65) Prior Publication Data

US 2010/0087076 A1 Apr. 8, 2010

(30) Foreign Application Priority Data

Nov. 17, 2006 (SE) ..... 0602480

(51) Int. Cl.
*H01R 25/00* (2006.01)

(52) U.S. Cl. ..... 439/110

(58) Field of Classification Search ..... 439/110, 439/118, 121, 119, 116, 136
See application file for complete search history.

(56) References Cited

U.S. PATENT DOCUMENTS

| | | | | |
|---|---|---|---|---|
| 3,503,032 | A | 3/1970 | Routh et al. | |
| 3,801,951 | A * | 4/1974 | Kemmerer et al. | 439/116 |
| 4,243,284 | A * | 1/1981 | Humphreys | 439/113 |
| 4,645,286 | A * | 2/1987 | Isban et al. | 439/571 |
| 5,759,051 | A * | 6/1998 | Cancellieri et al. | 439/118 |
| 6,039,584 | A * | 3/2000 | Ross | 439/115 |
| 6,857,883 | B2 * | 2/2005 | Tang | 439/116 |
| 7,128,585 | B2 * | 10/2006 | Evilsizer | 439/120 |
| 7,547,221 | B2 * | 6/2009 | Kim et al. | 439/211 |

FOREIGN PATENT DOCUMENTS

| | | |
|---|---|---|
| DE | 1 765 561 | 5/1972 |
| DE | 26 36 591 | 7/1977 |
| WO | WO 98/53533 | 11/1998 |

OTHER PUBLICATIONS

International Search Report for International Application No. PCT/SE2007/050861 dated Feb. 21, 2008.

* cited by examiner

*Primary Examiner* — Jean F Duverne
(74) *Attorney, Agent, or Firm* — Fish & Richardson P.C.

(57) ABSTRACT

The present invention relates to a connector arrangement (30) for connecting a connector device (40) to a conductor (15*a*-16*e*) in a carrying structure (12), which connection arrangement (30) comprises a neck portion (31) and a body (32) transversally extending from said neck portion, said body comprising at least one connection surface (33*a*-33*e*) for connection of said conductor and connection of the same to said connector device. Said body comprises a first and a second portion and that said first portion has a dimension different than the dimension of said second portion, and that each portion comprises a substantially U and/or V shaped recess (34*a*, 34*b*) in the longitudinal direction of said body.

12 Claims, 5 Drawing Sheets

CONDUCTOR ARRANGEMENT, SYSTEM AND METHOD

TECHNICAL FIELD

The present invention relates to an arrangement provided as a conductor rail, and connector device of the type which is connected to the rail.

BACKGROUND OF THE INVENTION

The cost for installing cables in new buildings and new cables in old buildings is usually high. Moreover, in new installations a lot of work is done to drill holes and installation, if there is room.

The modern community with increasing number of computerization, multimedia, smart houses, etc., call for more cables in both new and old buildings.

There are a number of different solutions. These are usually circumstantial because installation and post-installation demand a lot of work. Moreover, these are difficult to produce which means higher cost.

WO 98/53533 relates to a protection device for a connector which can be inserted into a rail and which is provided with a locking device, which when locked allows electrical connection. This design is complicated and difficult to manufacture.

DE 2636591 describes an arrangement (end section) to connect electrical current to a conductor rail. The arrangement is inserted into the rail through an opening in one end.

U.S. Pat. No. 3,503,032 relates to connector system for connecting connectors to cables in a rail. Connection is not achieved by means of the connector part according to the present invention.

DE 1765561 describes a connector in which the connection is obtained by means of connectors connected to channels at the edge of the rail's opening.

SUMMARY OF THE INVENTION

The object of the present invention is to provide a simple system for installation of conductors which substitutes ordinary cables and also in a simple way connects plug sockets and devices. Other advantages with the invention are that it allows installation of conductors for different purposes and thereby connection of different connector types individually or on a same component. Moreover, the installation of the conductors will become independent of the standards, e.g. in different countries, as only the design of the connector parts must be varied. Furthermore, the invention provides additional security, because access to the conductive parts of the rail is made difficult. A rail according to the present invention may be made and adapted to different environments both with respect to functionality and aesthetical viewpoint.

For these reasons a connector arrangement is provided for connecting a connector device to a conductor in a carrying structure. The connector arrangement comprises a neck portion and a body transversally extending from the neck portion. The body comprises at least one connection surface for connection of the conductor and connection of the same to the connector device. The body comprises a first and a second portion and that the first portion has a dimension different than the dimension of the second portion. Each portion comprises a substantially U and/or V shaped recess in the longitudinal direction of the body. The carrying structure comprises a channel corresponding to the shape of the connector arrangement. Preferably, the connector arrangement is substantially T-shaped. According to one embodiment, the body is provided with at least one connection surface. Preferably, the connector arrangement is provided to be inserted in the structure in a first position and turn to a second position for locking and connection.

The invention also relates to an oblong structure comprising a space for receiving a connector arrangement, the structure comprises a channel in the longitudinal direction of the structure provided with an opening and at least one conductor in the longitudinal direction of the space. The channel comprises a first space and a second space arranged to receive and lock the connector arrangement in a connection position. The first and second spaces have different dimensions and that walls of the channel are provided with substantially U and/or V shaped tongues. Preferably, the channel is substantially T-shaped. The structure may comprise a covering, which covers the channel and has a flexible surface. The structure may comprise one or several of a surge protection, timer, and residual current device.

The invention also relates to a connector device comprising a connector arrangement as described above.

The invention also relates to a joint unit for connecting at least two structures, as mentioned above, in one direction.

The invention also relates to a method of securely connecting a plug socket to a rail, which socket is provided with a substantially T-shaped connector arrangement in one extension direction of the socket, the rail comprising a channel provided with a substantially U-shaped and/or V-shaped tongues for reception of the connector arrangement and at least one conductor. The method comprises insertion of the connector arrangement in a first position in the channel and turning the connector arrangement to a second position for connection to the conductor.

BRIEF DESCRIPTION OF THE DRAWINGS

In the following, the invention is described with reference to a number of embodiments illustrated in the drawings, in which.

DETAILED DESCRIPTION OF PREFERRED EMBODIMENTS

Figure 1:
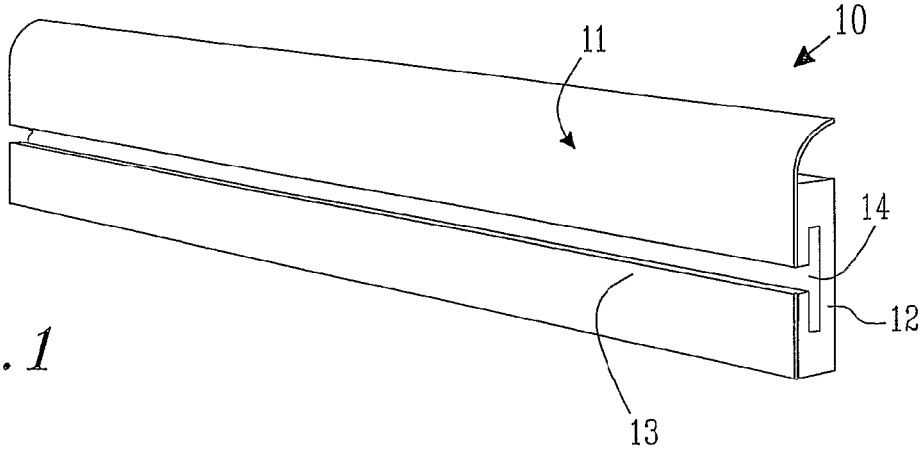
FIG. 1 shows a view in perspective of a rail according to the invention.
Figure 2:
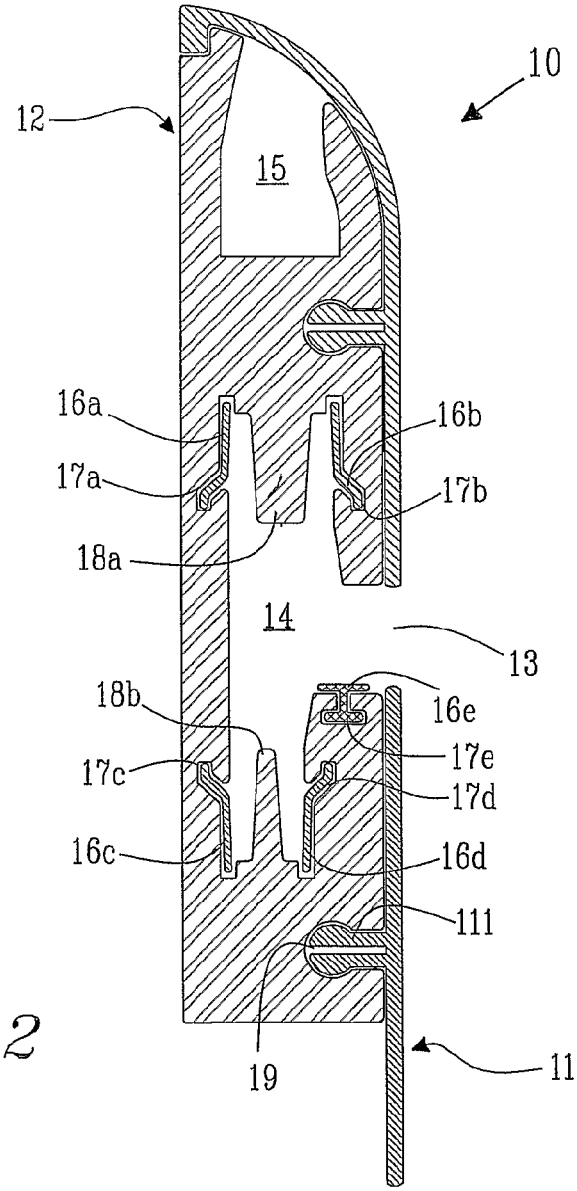
FIG. 2 shows a cross section along lines II-II in FIG. 1.
Figure 4:
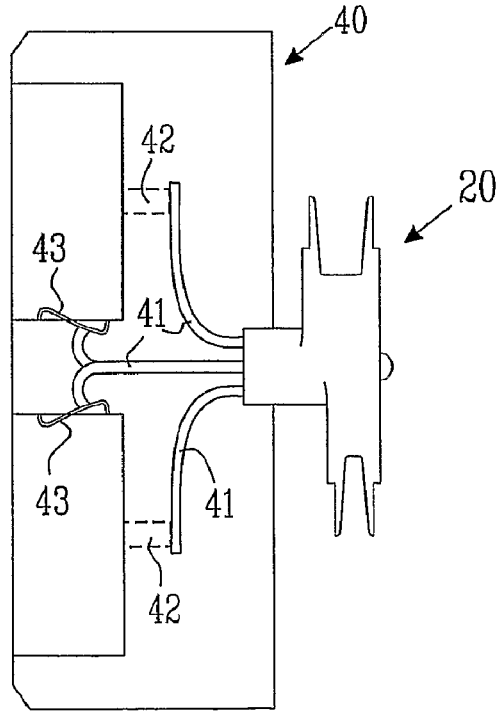
FIG. 4 shows a plug socket according to the invention.

FIGS. 1 and 2 illustrate a rail 10 according to one exemplary embodiment of the invention, for connecting a plug socket, e.g. according to FIG. 4. The rail 10 comprises an outer covering 11 and an internal rail 12.

The external covering 12, which is made of a suitable material, such as plastic, in suitable oblong sections comprises, beside the receiving space 14, a second space 15, e.g. for receiving other cables or the like.

The receiving space 14, which is substantially T-shaped, is arranged to receive a connector unit, which will be described thoroughly further below. The receiving space is a channel which extends substantially along the entire rail's length and comprises one or several connector parts 16*a*-16*e* arranged parallel in the longitudinal plane of the rail and an insertion part 13 perpendicular to the connector part but having an open end towards one side of the rail.

The connector parts 16*a*-16*e* are arranged as resilient foils inserted in corresponding channels 17*a*-17*e* in the inner rail 12. The connector parts 16*a*-16*c* are resiliently arranged mainly towards the center axis of the inner rail.

The receiver space, which is substantially T-shaped, has different dimensions, according to the drawing, an upper wider and a lower smaller channel (in the plane of the drawing) and comprises further tongues 18*a* and 18*b* in each gable section of the space having variable sizes.

Moreover, the inner rail comprises the space 19 for reception of the outer covering 11. The outer covering 11, mainly being provided for decorative reasons, can be made of a suitable material, such as plastic, aluminum or the like, and is snapped in the mentioned receiving spaces 19 by means of snapping parts 111 on the backside of the covering 11. This allows using several different types of fronts for the rail depending on, e.g. environment, within which the rail is used.

Figure 3:
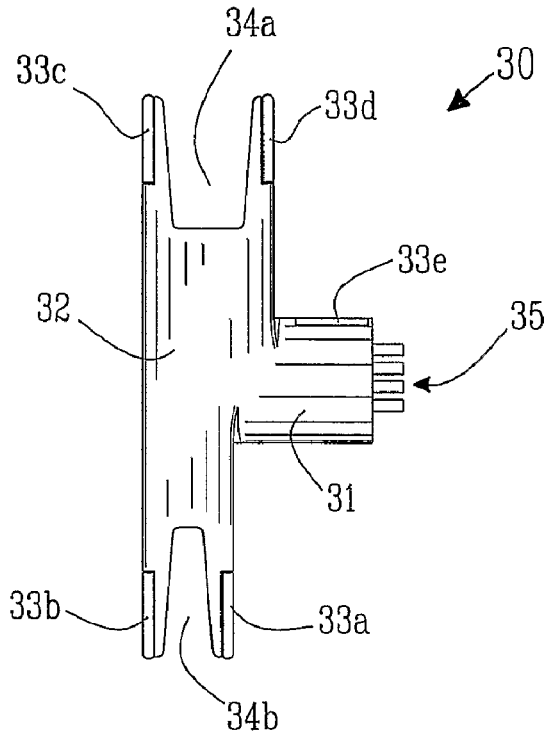
FIG. 3 shows a side view of a connector unit according to the invention.

FIG. 3 illustrates a side view of a connector unit 30 according to the invention. The connector unit 30 comprises a neck 31, which on one side is provided with a transverse beam 32. The beam, which is connected to the neck 31 substantially at its middle section, is arranged with variable dimensions at each side of the neck, formed as two substantially U-shaped and/or V-shaped ends 34*a* and 34*b*, respectively. The beam is provided with contact surfaces 33*a*-33*d* near each end on the surface. Obviously, the contact surfaces may also be provided on the inside of the U-shaped ends. A contact surface 33 is also arranged on the neck 31. The contact surfaces 33*a*-33*e* are coupled out of the neck through conductors 35 through the neck 31. The connector part may be arranged as spring by means of a resilient part, which extends from the beam's lower part. Preferably, the neck and the beam are made in one piece from a non-conductive material, such as plastic.

The U-shaped and/or V-shaped ends 34*a*, 34*b* are formed to fit into the above-mentioned receiver space's tongues 18*a*, 18*b* in the rail.

The connector part 30 may be connected to the backside of a conventional or especially made socket 40, FIG. 4, to couple and lock the socket to the rail according to the invention. Electrical connectors, e.g. in form of wires 41 are connected between the connector part's contact surfaces 33*a*-33*e*, the holes 42 and ground connections 43, respectively, according to the illustrated embodiment. The connector part may either be provided with conductive surfaces from the connection surfaces to the neck where the wires are connected or the wires or conductive surfaces may be arranged on the inside of the connector part, as mentioned earlier.

The varying size of the beam allows the connector part to turn and be positioned only in one way within the receiving space and accordingly contact right conductors.

Figure 5:
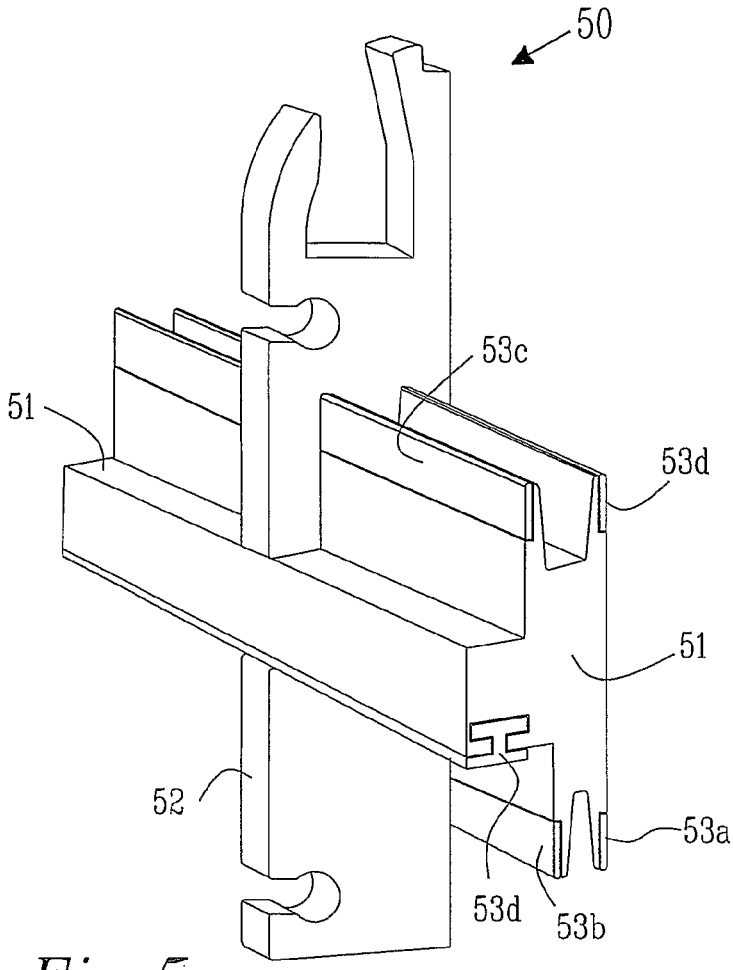
FIG. 5 shows a joint unit according to the invention in perspective.

The rail may be manufactured in long pieces and cut to the desired lengths. By means of a joint unit 50, as shown in FIG. 5, the rails can be joined wherever needed. The joint unit 50, which according to this example is substantially cross shaped, comprises insertion part 51 and a central portion 52. The insertion part is arranged to fit the form of the receiving space in the rail and has a cross section substantially similar to the T-shape of the connector part 30. In same way as the connector part 30, the joint unit is provided with connections surfaces 53*a*-53*d* for contacting the joined rails.

Figure 6:
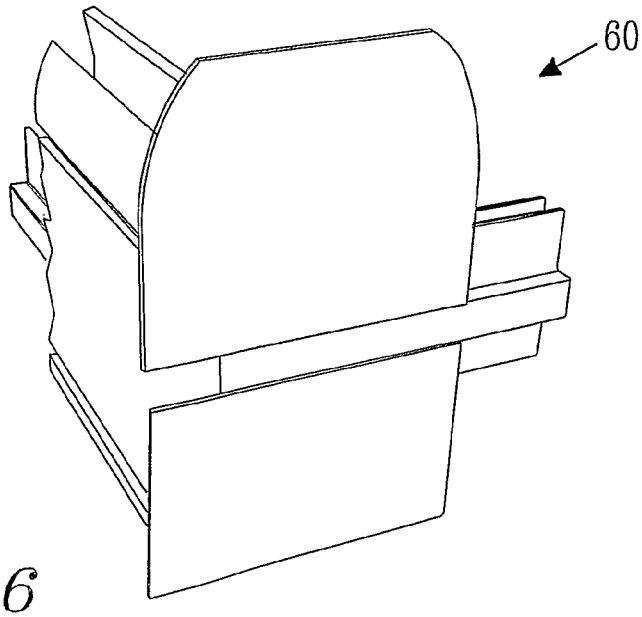
FIG. 6 shows a corner part according to the invention in perspective.

A corner part 60, illustrated in FIG. 6, may be used to connect the rails at the corners. The corner parts are made in same way as the joint unit, which was described above. The corner part may be angled in different directions and degrees. The embodiment illustrated in the drawing is partly covered with an outer covering.

Besides the corner part, other parts such as T-shape or cross connections may also occur for dividing conductors in different directions.

Figure 7:
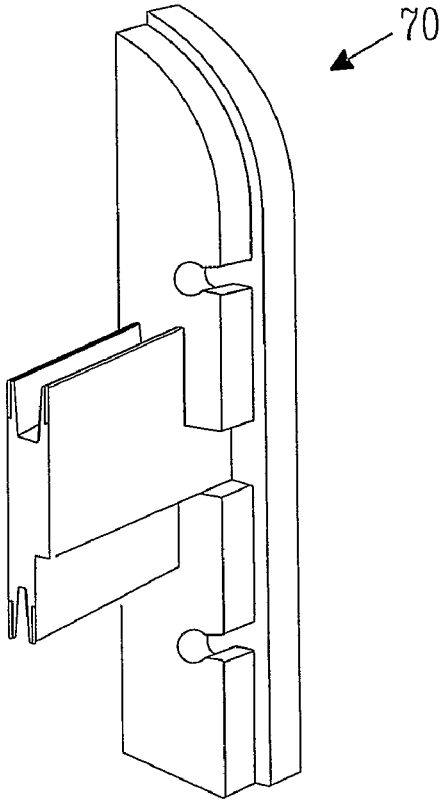
FIG. 7 shows an end part according to the invention in perspective.

FIG. 7 illustrates an end piece 70. The end piece is intended for termination of the rail and isolation of the conductors where the rail ends.

The notch 13 in the outer covering 11 can cover the opening of the channel 12 and may be a weakening in the covering material. The inner rail may be provided with different screw bores for installation in different spaces or environments. When installing, the inner rail can is fastened first and after which the covering is snapped on. The rail can be manufactured in different lengths, which can be cut to desired lengths. Fitting units can be produced for connecting at the ends such that two rails can be connected, e.g. by means of drilled holes on a wall or when changing direction.

Figure 8:
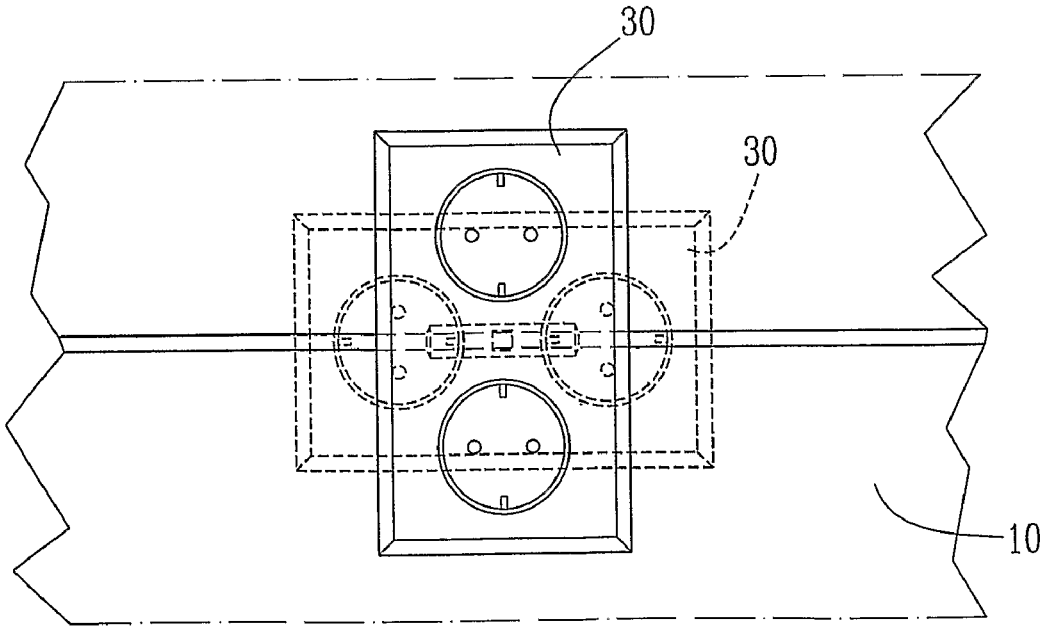
FIG. 8 shows schematically coupling steps according to the invention.

FIG. 8 shows connection procedure for connecting a plug socket, e.g. the one according to FIG. 4, to the rail. In a first position, illustrated by hatched lines, the socket is positioned horizontally on the rail and pushed into the notch and the substantially T-shaped channel in the inner rail. Then the socket is turned counter clockwise or clock wise, in about 90 degrees. Spring-load may be used to press the T-shaped connector part from the back plane and rest on an opposite surface in the substantially T-shaped channel and thereby locking the plug socket in place. Naturally, this procedure depends on the positioning of the connector part with respect to the socket.

The conductors in the rail may be of different types, electric cables (two or three phase), signal wires, e.g. telephone wires, or different types of data signals, for connection to a computer network, such as ADSL, XDSKL. Of course, a combination of electrical conductors and other conductors may occur.

Figure 9:
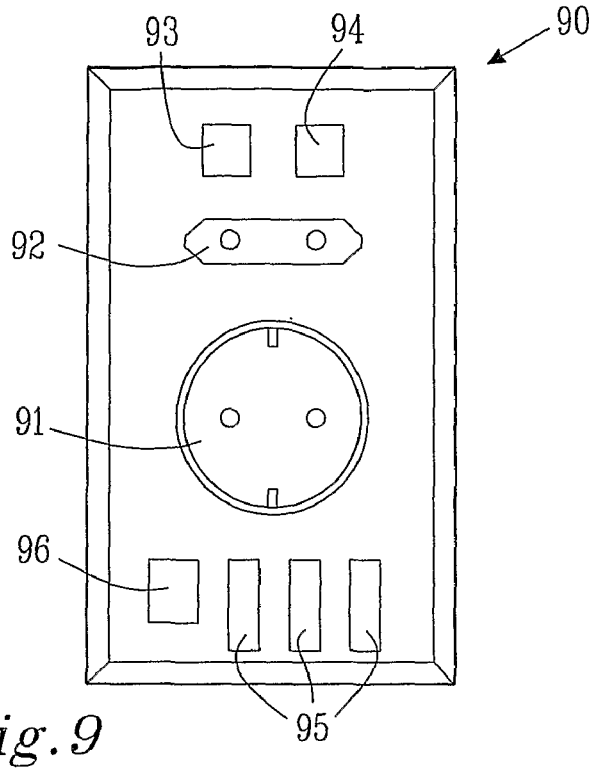
FIG. 9 shows a second embodiment of a socket according to the invention.

FIG. 9 illustrates a second embodiment of the socket 90, comprising several types of electrical plugs 91 and 92, telephone socket 93, Ethernet connection 94, USB connection 95 and Firewall connection 96. Of course, optical fibres with optical connectors may also be used.

Figure 10A:
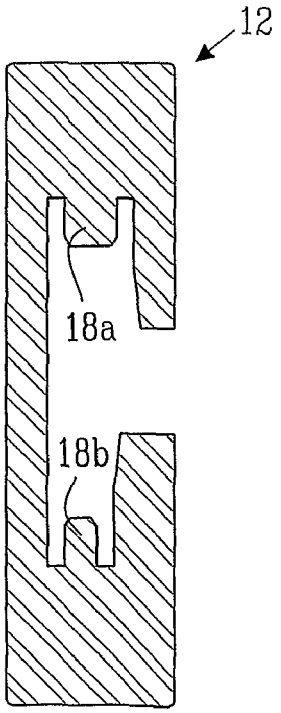
FIGS. 10*a* and 10*b* illustrate schematically a cut through a rail according to a second embodiment of the invention.
Figure 10B:
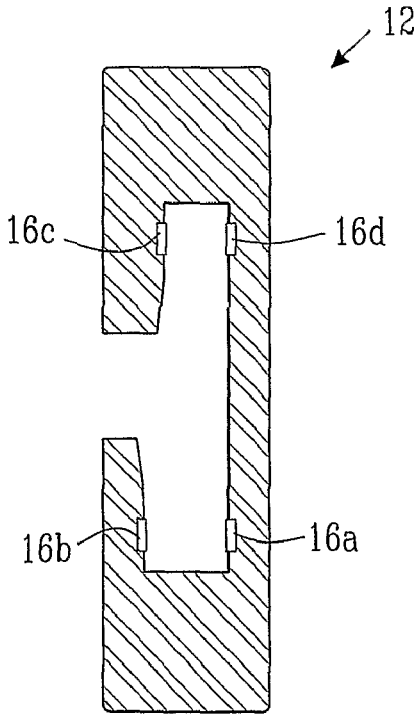

FIGS. 10*a* and 10*b* show two different embodiments of the inner rail 12. According to FIG. 10*a*, the tongues 18*a* and 18*b* are shaped substantially square. According to FIG. 10*b*, the tongues are missing and connection surfaces 16*a*-16*d* are provided on the bottom surface of the rail.

Moreover, other apparatuses such as surge protection, timer, residual current device, etc., may also be installed in the rail, e.g. by using a module.

The invention is not limited to the illustrated and described embodiments. The invention may be varied in a number of ways within the scope of the attached claims depending on the needs.

The invention claimed is:

1. A connector arrangement of an outlet connector device to a conductor in a carrying structure, which connector arrangement comprises a neck portion and a body transversally extending from said neck portion, said body comprising at least one connection surface for connection of said conductor and connection of the same to said connector arrangement, wherein said body comprises a first and a second portion and that said first portion has a dimension different than the dimension of said second portion, and that each portion comprises a substantially U and/or V shaped recess in the longitudinal direction of said body, that connector arrangement is further configured to be inserted transversally in said carrying structure in a first direction through a channel between a first and a second end of said carrying structure and rotated into a second direction to allow establishment of contact with said conductors.

2. The connector arrangement of claim 1, wherein said channel corresponds to the shape of said connector arrangement.

3. The connector arrangement of claim 1, wherein said connector arrangement is substantially T-shaped.

4. The connector arrangement of claim 1, wherein said body is provided with at least one connection surface.

5. The connector arrangement of claim 1, comprising terminals for one or several of electric output, signal wires, telephony, data signals for connection to a computer network, such as ADSL, XDSKL, Ethernet, USB, Firewall, and optical connectors.

6. An oblong structure comprising a space for receiving a connector arrangement, said structure comprising a channel in the longitudinal direction of said structure provided with an opening and in the longitudinal direction of said space at least one conductor, wherein said channel comprises a first space and a second space configured to receive said connector arrangement transversally and allow said connector arrangement to be rotated into a second direction and lock said connector arrangement in a connection position and that said first and second spaces have different dimensions and that walls of said channel are provided with substantially U and/or V shaped tongues.

7. The structure of claim 6, wherein said channel is substantially T-shaped.

8. The structure of claim 6, wherein said structure comprises a covering, which covers said channel and has a flexible surface.

9. The structure of claim 6, wherein said structure comprises one or several of a surge protection, timer, and residual current device.

10. The structure of claim 6, further comprising wiring for one or several of electric output, signal wires, telephony, data signals for connection to a computer network, such as ADSL, XDSKL, Ethernet, USB, Firewall, and optical connectors.

11. A connector device comprising a connector arrangement connector arrangement of an outlet connector device to a conductor in a carrying structure, which connector arrangement comprises a neck portion and a body transversally extending from said neck portion, said body comprising at least one connection surface for connection of said conductor and connection of the same to said connector arrangement, wherein said body comprises a first and a second portion and that said first portion has a dimension different than the dimension of said second portion, and that each portion comprises a substantially U and/or V shaped recess in the longitudinal direction of said body, that connector arrangement is further configured to be inserted transversally in said carrying structure in a first direction through a channel between a first and a second end of said carrying structure and rotated into a second direction to allow establishment of contact with said conductors.

12. A joint unit for connecting at least two oblong structures in one or several directions, each structure comprising a space for receiving a connector arrangement, said structure comprising a channel in the longitudinal direction of said structure provided with an opening and in the longitudinal direction of said space at least one conductor, wherein said channel comprises a first space and a second space configured to receive said connector arrangement transversally and allow said connector arrangement to be rotated into a second direction and lock said connector arrangement in a connection position and that said first and second spaces have different dimensions and that walls of said channel are provided with substantially U and/or V shaped tongues.

* * * * *